US009080420B2

(12) United States Patent
Flores et al.

(10) Patent No.: US 9,080,420 B2
(45) Date of Patent: Jul. 14, 2015

(54) MULTIPLE SHIFT SLIDING SLEEVE

(75) Inventors: Antonio B. Flores, Houston, TX (US); David Ward, Houston, TX (US); Cesar G. Garcia, Katy, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 229 days.

(21) Appl. No.: 13/568,774

(22) Filed: Aug. 7, 2012

(65) Prior Publication Data

US 2013/0043042 A1 Feb. 21, 2013

Related U.S. Application Data

(60) Provisional application No. 61/525,544, filed on Aug. 19, 2011.

(51) Int. Cl.
*E21B 34/14* (2006.01)
*E21B 43/26* (2006.01)

(52) U.S. Cl.
CPC ..... *E21B 34/14* (2013.01); *E21B 43/26* (2013.01)

(58) Field of Classification Search
CPC .... E21B 34/14; E21B 2034/007; E21B 23/08
USPC ..... 166/373, 374, 318, 319, 332.4
See application file for complete search history.

(56) References Cited

U.S. PATENT DOCUMENTS 3,799,278 A 3/1974 Oliver
7,543,636 B2 * 6/2009 Malone et al. ..... 166/252.4
2009/0044944 A1 2/2009 Murray et al.
2011/0198100 A1 8/2011 Braekke et al.
2011/0203809 A1 8/2011 Knobloch, Jr. et al.
2011/0315389 A1 12/2011 Knoblach, Jr. et al.
2012/0085548 A1 * 4/2012 Fleckenstein et al. ..... 166/373
2014/0048271 A1 * 2/2014 Coon et al. ..... 166/308.1

FOREIGN PATENT DOCUMENTS

CA 2776560 6/2011
RU 2314415 C2 1/2008
RU 2316643 C2 2/2008
RU 2351746 C2 4/2009
RU 2354801 C2 5/2009

OTHER PUBLICATIONS

First Office Action in counterpart CA Appl, 2,785,510, dated Oct. 24, 2013.
Examiner's Second Requisition received in corresponding Canadian Application No. 2,785,510, dated Jul. 14, 2014.
(Continued)

*Primary Examiner* — Brad Harcourt
(74) *Attorney, Agent, or Firm* — Wong, Cabello, Lutsch, Rutherford & Brucculeri LLP

(57) ABSTRACT

A system of sliding valves wherein the inserts of multiple sliding valves may be shifted to an open position using a single shifting ball. Each individual sliding valve has a movable insert that, depending upon the position of the insert within the sliding valve, may either block or permit fluid to radially flow between the interior and exterior of the sliding valve. The insert has a profile about the interior of the movable insert allowing a shifting tool to connect to and move the insert so that fluid may be prevented from entering the interior portion of the sliding sleeve.

21 Claims, 5 Drawing Sheets

(56) References Cited

OTHER PUBLICATIONS

Patent Examination Report No. 1 received in corresponding Australian application No. 2012216237, dated Feb. 10, 2014.

Office Action received in corresponding Russian application No. 2012135478, dated Mar. 23, 2014.

Decision on Grant in corresponding Russian application No. 2012135478, dated Jun. 16, 2014.

* cited by examiner

MULTIPLE SHIFT SLIDING SLEEVE

CROSS-REFERENCE TO A RELATED APPLICATION

This is a non-provisional application which claims priority to provisional application 61/525,544, filed Aug. 19, 2011, the contents of this application is incorporated herein by reference.

BACKGROUND

A common practice in producing hydrocarbons is to fracture the hydrocarbon bearing formation. Fracturing the hydrocarbon bearing formation increases the overall permeability of the formation and thereby increases hydrocarbon production from the zone fractured. Increasingly a single wellbore may intersect multiple hydrocarbon bearing formations. In these instances each hydrocarbon bearing zone may be isolated from any other and the fracturing operation proceeds sequentially through each zone.

In order to treat each zone sequentially a fracturing assembly is installed in the wellbore. The fracturing assembly typically includes of a tubular string extending generally to the surface, a wellbore isolation valve at the bottom of the string, various sliding sleeves placed at particular intervals along the string, open hole packers spaced along the string to isolate the wellbore into zones, and a top liner packer.

The fracturing assembly is typically run into the hole with the sliding sleeves closed and the wellbore isolation valve open. In order to open the sliding sleeves a setting ball, dart, or other type of plug is deployed into the string. For the purposes of the present disclosure a ball may be a ball, dart, or any other acceptable device to form a seal with a seat.

SUMMARY

The sliding sleeve has a movable insert that blocks radial fluid flow through the sliding sleeve when the sliding sleeve is closed. Fixed to the insert is a releasable seat that is supported about the seats periphery by the internal diameter of the housing. Upon reaching the first releasable seat the ball can form a seal. The surface fracturing pumps may then apply fluid pressure against the now seated ball and the corresponding releasable seat to shift open the sliding sleeve permanently locking it open. As the sliding sleeve and its corresponding seat shift downward the seat reaches an area where the releasable seat is no longer supported by the interior diameter of the housing causing the releasable seat to release the ball. The ball then continues down to seat in the next sliding sleeve and the process is repeated until all of the sliding sleeves that can be actuated by the particular ball are shifted to a permanently open position and the ball comes to rest in a ball seat that will not release it thus sealing the wellbore.

Once the lower wellbore is effectively sealed by the seated shifting ball and the sliding sleeves are open the surface fracturing pumps may increase the pressure and fracture the hydrocarbon bearing formation adjacent to the sliding sleeves providing multiple fracturing initiation points in a single stage.

Because current technology allows multiple sliding sleeves to be shifted by a single ball size multiple hydrocarbon bearing zones may be fractured in stages where the lower set of sliding sleeves utilizes a small diameter setting ball and seat and successively higher zones utilize successively greater diameter setting ball and seat sizes.

A cluster of sliding sleeves may be deployed on a tubing string in a wellbore. Each sliding sleeve has an inner sleeve or insert movable from a closed condition to an opened condition. When the insert is in the closed condition, the insert prevents communication between a bore and a port in the sleeve's housing. To open the sliding sleeve, a ball is dropped into the wellbore and pumped to the sliding sleeve where it forms a seal with the releasable seat. Keys or dogs of the insert's seat extend into the bore and engage the dropped ball, providing a seat to allow the insert to be moved open with applied fluid pressure. After opening the external diameter of the housing is in fluid communication with the interior portion of the housing through the ports in the housing.

When the insert reaches its open position the keys retract from the bore and allows the ball to pass through the seat to another sliding sleeve deployed in the wellbore. This other sliding sleeve can be a cluster sleeve that opens with the same ball and allows the ball to pass through after opening. Eventually, however, the ball can reach an isolation sleeve or a single shot sliding sleeve further down the tubing string that opens when the ball engages its seat but does not allow the ball to pass through. Operators can deploy various arrangements of cluster and isolation sleeves for different sized balls to treat desired isolated zones of a formation.

After the various sliding sleeves are actuated it is sometimes necessary to run a milling tool through the wellbore to ensure that the inner diameter of the tubular is optimized for the fluid flow of the particular well. The mill out may include removing portions of sliding sleeve ball seats that are not releasable and any other debris that may be left over from the fracturing process.

At some point over the life of the well it may become desirable to seal off the radial fluid communication between the interior of the sliding sleeve housing and the exterior of the sliding sleeve housing thereby sealing off a portion of the previously accessed formation. To accomplish sealing off a portion of the formation a shifting profile or other on demand actuating device is incorporated into the sliding sleeves. A shifting tool may be deployed into the well on coiled tubing, well tractor, etc, or other suitable device. The shifting tool is deployed into the wellbore until the appropriate sliding sleeve is reached. The shifting tool is then activated to engage a preformed shifting profile on the sliding sleeve insert. Force is then applied via the shifting tool to the insert and the insert is moved between an open position and a closed position.

In one embodiment at least two sliding sleeves may be used together in a wellbore wherein each sliding sleeve has a housing having an outer diameter, an inner diameter, and a port allowing fluid communication between the inner diameter and the outer diameter, an insert located about the inner diameter of the housing and having an outer insert diameter, an inner insert diameter, a releasable seat, and a shifting profile about the inner insert diameter, the releasable seat engages the insert to move the insert between a first position and a second position, the shifting profile engages the insert to move the insert between the second position and the first position. The shifting profile may be engaged by a shifting tool operated from the surface or remotely by a device located inside of the wellbore using any type of acceptable actuating mechanism such as coiled tubing or a wellbore tractor. In many instances the insert is retained in either or both the open or closed position. Preferably a snap ring is the retaining or locking mechanism.

In another embodiment multiple sliding sleeves may be used together in a wellbore wherein each sliding sleeve has a central bore through its central mandrel and disposed on a tubing string deployable in a wellbore, each of the multiple sliding sleeves may be actuated by a single plug deployable down the tubing string to actuate all of the sliding sleeves sized for the single plug, each of the sliding sleeves being actuable between a closed condition and an opened condition, the closed condition preventing fluid communication between the central throughbore and the wellbore, the opened condition permitting fluid communication between central throughbore and the wellbore, each of the sliding sleeves allowing the single plug to pass therethrough after opening. The sliding sleeves are actuated by a shifting tool from the open position to the closed position. The shifting tool may be operated from the surface or may be operated remotely while in the wellbore using any type of acceptable actuating method such as coiled tubing or a wellbore tractor. In many instances the sliding sleeves are retained so that they may be secured in either the open or closed position. Preferably a snap ring is the securing or locking mechanism.

A method of treating a wellbore where at least two sliding sleeves are deployed in to well on a tubing string, each of the sliding sleeves having a central throughbore and a closed condition preventing radial fluid communication between the central throughbore and the wellbore; a ball is dropped down the tubing string thereby changing the sliding sleeves from its closed condition to an open condition allowing radial fluid communication between the central throughbore and the wellbore by forming a seal between the plug and the seat disposed in the sliding sleeves; and after opening the sliding sleeves the plug is allowed to pass through the sliding sleeve. The sliding sleeves are actuated from the open to the closed position by a shifting tool which may be deployed into the well by any suitable means such as coiled tubing or a well tractor. The shifting tool may be controlled either from the surface or remotely while deployed in the wellbore.

The foregoing summary is not intended to summarize every potential embodiment of the present invention.

DETAILED DESCRIPTION

The description that follows includes exemplary apparatus, methods, techniques, and instruction sequences that embody techniques of the inventive subject matter. However, it is understood that the described embodiments may be practiced without these specific details.

Figure 1:
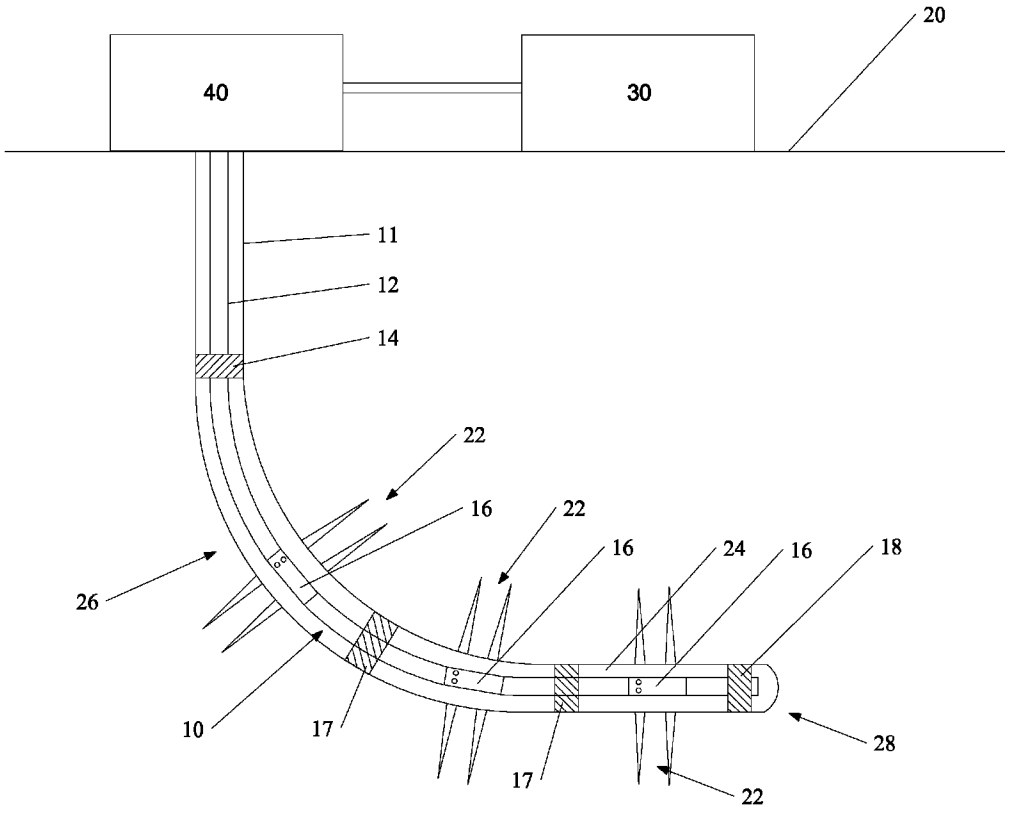
FIG. 1 depicts a schematic view of a fracturing assembly installed in a wellbore.

FIG. 1 depicts a schematic view of a wellbore 11 with a single zone and having a fracturing assembly 10 therein. The fracturing assembly 10 typically consists of a tubular string 12 extending to the surface 20, an open hole packer 14 near the upper end of the sliding sleeves 16, and a wellbore isolation valve 18. At the surface 20, the tubular string 12 is connected to the fracturing pumps 30 through the rig 40. The fracturing pumps 30 supply the necessary fluid pressure to activate the sliding sleeves 16. The open hole packer 14 at the upper end of the sliding sleeves 16 isolates the upper end of the formation zone 22 being fractured. At the lower end of the sliding sleeves 16 a wellbore isolation valve 18 is placed to seal the lower end of the formation zone being fractured.

The fracturing assembly 10 may be assembled and run into the wellbore 11 for a predetermined distance such that the wellbore isolation valve 18 is past the end of the formation zone 22 to be fractured. The fracturing assembly 10 and the wellbore 11 form an annular area 24 between the fracturing assembly 10 and the wellbore 11. The open hole packer 14 is placed above the formation zone 22, and the sliding sleeves 16 are distributed in the appropriate places along the formation zone 22. Typically, when the fracturing assembly 10 is run into the wellbore 11 each of the sliding sleeves 16 are closed, the wellbore isolation valve 18 is open, and the open hole packer 14 is not set. The area towards the bottom end of the wellbore 11 is usually referred to as the toe 28 of the well and the area towards the upper end of the wellbore 11 where the wellbore 11 turns in a generally horizontal direction is usually referred to as the heel 26 of the wellbore 11.

Once the fracturing assembly 10 is properly located in the wellbore 11 the operator pumps down a shifting ball, dart, or other type of plug 66 to shift open the desired sliding sleeves 16. Upon reaching the first appropriately sized releasable seat 52 the ball can form a seal.

Figure 2:
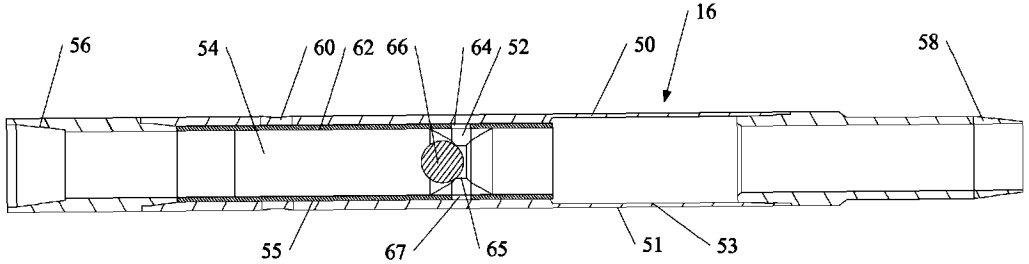
FIG. 2 depicts a sliding sleeve with a releasable seat in the closed position.
Figure 3:
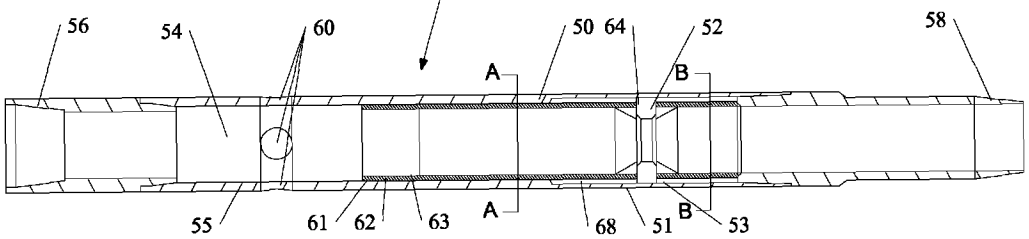
FIG. 3 depicts a sliding sleeve with a releasable seat in the open position.
Figure 3B:
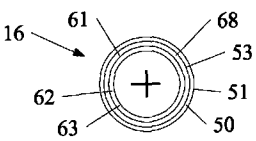
FIG. 3BB depicts a cross-section of the sliding sleeve of FIG. 3 at BB.
Figure 3A:
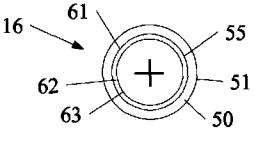
FIG. 3AA depicts a cross-section of the sliding sleeve of FIG. 3 at AA.

FIG. 2 depicts a sliding sleeve 16 in a closed position with a type of releasable ball seat 52. FIG. 3 depicts the sliding sleeve 16 in the open position and includes like reference numbers. As depicted in in the cross-section of FIG. 3 depicted in FIG. 3AA, the sliding sleeve 16 has a housing 50, with an outer diameter 51, an inner diameter 53 defining a longitudinal bore therethrough 54, and having ends 56 and 58 for coupling to the tubular string 12. Ports 60 are formed in the housing 50 to allow fluid communication between the interior of the housing 50 and the exterior of the housing 50. Located about the interior of the housing 50 is an inner sleeve or insert 62 having an outer insert diameter 61 and an inner housing diameter 63 that is movable between an open position (see FIG. 3) and a closed position (see FIG. 2). The insert 62 has slots 64 formed about its circumference to accommodate the releasable seat 52. The releasable seat 52 is supported about its exterior diameter by the inner diameter of the housing 50.

As depicted in FIG. 2, conventionally, the operator uses the fracturing pumps 30 to force a shifting ball 66 down the wellbore 11. When the shifting ball 66 engages and seats on the releasable seat 52 a seal is formed. The fluid pressure above the shifting ball 66 is increased by the fracturing pumps 30 causing the releasable seat 52 and its corresponding insert 62 to move towards the bottom of the wellbore 11. As the insert 62 moves towards the toe 28, the wellbore ports 60 are uncovered allowing radial access between the interior portion of the housing 50 or the housing longitudinal bore 54 and the exterior portion of the housing 50 accessing the formation zone 22. As the releasable seat 52 and insert 62 move together the releasable seat 52 reaches an at least partially circumferential slot 68 as depicted in in the cross-section of FIG. 3 depicted in FIG. 3BB. The at least partially circumferential slot 68 may be located in the inner diameter of the housing 50 where typically material has been milled away to increase the inner diameter of the housing 50. Before the shifting ball 66 actuates the sliding sleeve 16, moving the releasable seat 52 and insert 62, the releasable seat 52 is supported by the inner diameter of the housing 55. As the outer diameter of the releasable seat 67 reaches the slot 68 the releasable seat 52 recesses into the at least partially circumferential slot 68. Typically, the releasable seat 52 recesses into the at least partially circumferential slot 68 because as the releasable seat 52 and insert 62 move down the releasable seat 52 is no longer supported by the inner diameter of the housing 55, but is now supported by inner diameter 53, causing the outer diameter of the releasable seat 67 to move into the at least partially circumferential slot 68 and thereby causing a corresponding increase in the inner diameter of the releasable seat 65 thereby allowing the shifting ball 66 to pass through the sliding sleeve 16.

Figure 4B:
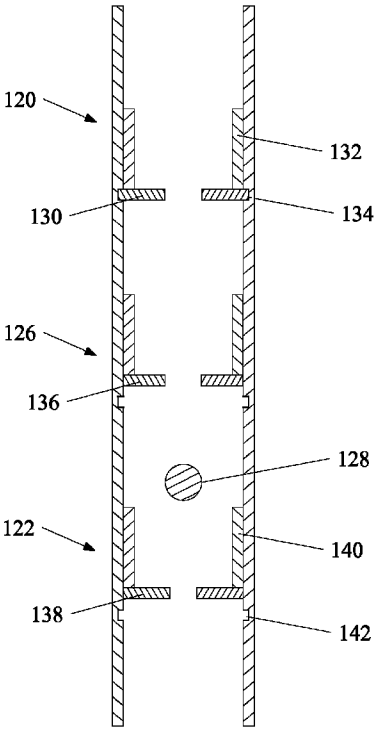
FIG. 4B depicts an array sliding sleeves using at least two different sizes of ball during activation.
Figure 4A:
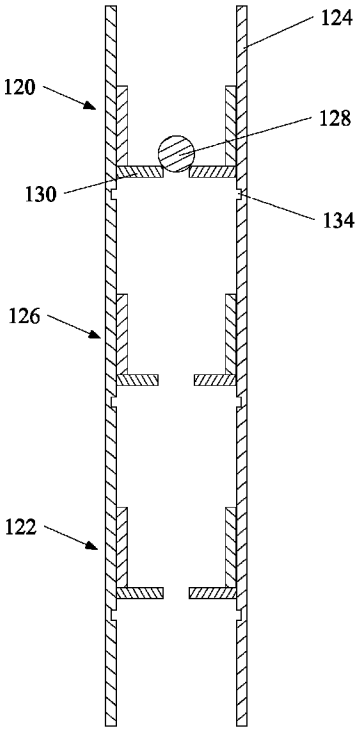
FIG. 4A depicts an array sliding sleeves using at least two different sizes of ball prior to activation.

Typically the sliding sleeves 16 are grouped together such that those sliding sleeves 16 actuated by a particular shifting ball size are located sequentially near one another. However it is sometimes desirable to open the sliding sleeves in a non-sequential manner. For example such as when interspersing at least three sliding sleeves actuated by two different several shifting balls sizes. In these instances while several sliding sleeves in the wellbore may be shifted by shifting balls of the same size, these sliding sleeves do not have to be sequentially located next to one another. For example as depicted in FIG. 4A sliding sleeves 120 and 122 are located in a tubular string 124 and are actuated by the same sized shifting ball 128. In FIG. 4A sliding sleeves 120 and 122 are placed above and below a third sliding sleeve 126 that is actuated by a different sized but larger shifting ball (not shown). The smaller shifting ball 128 can then be pumped down the well where it lands on the first releasable seat 130 in sliding sleeve 120. As depicted in FIG. 4B pressure from the fracturing pumps 30 (FIG. 1) against the shifting ball 128 and the corresponding releasable seat 130 forces the insert 132 and the first releasable seat 130 downwards until the releasable seat reaches the circumferential slot 134. The releasable seat 130 then moves outwardly into the circumferential slot 134 thereby increasing the inner diameter of the releasable seat 130 and releasing the shifting ball 128. The releasable seat 136 has a large enough inner diameter that shifting ball 128 passes through sliding sleeve 126 without actuating sliding sleeve 126. The shifting ball 128 will then land on the second releasable seat 138 forcing the insert 140 and the second releasable seat 138 downwards until the releasable seat reaches the circumferential slot 142. The second releasable seat 138 may then moves outwardly into the circumferential slot 142 thereby increasing the inner diameter of the releasable seat 138 and releasing the shifting ball 128.

After actuating the correspondingly sized sliding sleeves the shifting ball may then seat in the wellbore isolation tool 18 or actuate any other tool to seal against the wellbore 11. Fluid is then diverted out through the ports 60 in the sliding sleeves 16 and into the annulus 24 created between the tubular string 12 and the wellbore 11.

In order to isolate the formation zone 22 the open hole packer 14 and the packer associated with the wellbore isolation valve 18 may be set above and below the sliding sleeves 16 to isolate the formation zone 22, while isolation packers 17 may be placed between portions of the formation zone 22 or to isolate separate formations along the wellbore 11 from the rest of the wellbore 11.

The fracturing pumps 30 are now able to supply fracturing fluid at the proper pressure to fracture only that portion of the formation zone 22 that has been isolated. After the formation 22 has been fractured any hydrocarbons may be produced.

Over the life of the wellbore 11 the pressure in certain areas may become reduced or the wellbore 11 may begin to produce more water in certain areas, such as the heel 26, of the wellbore when compared to other areas of the wellbore. Such problems are more pronounced in horizontal wells where at times the heel 26 (FIG. 1) of the wellbore 11 will produce water and prevent hydrocarbons from flowing out of the toe 28 (FIG. 1) towards the surface 20. In such instances in order to maintain production from the formation zone 22 it would helpful to be able shut off or reduce the flow from the heel 26 of the wellbore 11 or from any other section of the wellbore as may be desired.

Figure 5:
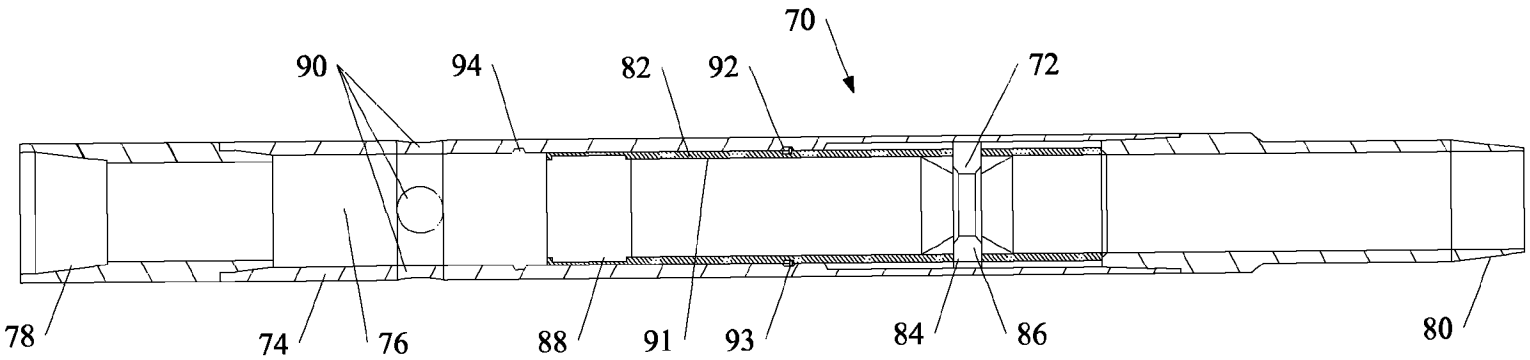
FIG. 5 depicts a sliding sleeve with a releasable seat in the open position and having a shifting profile.

FIG. 5 depicts a sliding sleeve 70 with a type of releasable ball seat 72 in the open position allowing fluid communication through the ports 90 between the interior of the housing and the exterior of the housing. The sliding sleeve 70 has a housing 74 defining a longitudinal bore 76 therethrough and having ends 78 and 80 for coupling to the tubing string. Located about the interior of the housing is an inner sleeve or insert 82 that is movable between an open position and a closed position. The insert 82 has slots 84 formed about its circumference to accommodate the releasable seat 86. The insert 82 has a profile 88 formed about the inner insert diameter 91. The profile 88 is typically formed by circumferentially milling away a portion of material around at least one end of the inner insert diameter 91. The releasable seat 86 is supported around the outer diameter of the releasable seat 67 by the inner diameter of the housing 74. A snap ring 93 is provided in circumferential slot 92 about the exterior diameter of insert 82. The snap ring 93 latches into circumferential slot 92 about the interior diameter of the housing 74 to retain the insert 82 in its open position. As the insert 82 is moved between its open position and its closed position the snap ring will retract into circumferential slot 92 until it reaches circumferential slot 94 about the interior diameter of the housing where it will expand into circumferential slot 94 and thereby retaining the insert 82 in the closed position.

Figure 6A:
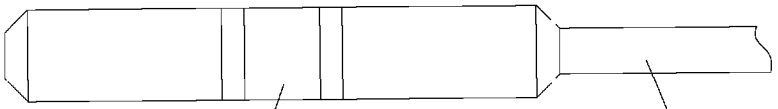
FIG. 6A depicts a shifting tool with the radially movable latch in the retracted position on coil tubing.

FIG. 6A depicts a shifting tool 100 having a radially movable latch 102A to latch into profile 88. The shifting tool 100 may be run into the fracturing assembly 10 on coiled tubing 106, by a wellbore tractor, or by any other means that can carry the shifting tool 100 into the fracturing assembly 10. Typically the shifting tool may be run into the wellbore 11 with the movable latch in a radially retracted position 102A reducing the outer diameter of the shifting tool 100 and allowing the shifting tool 100 to clear any areas of reduced diameter inside of the fracturing assembly 10.

Figure 6B:
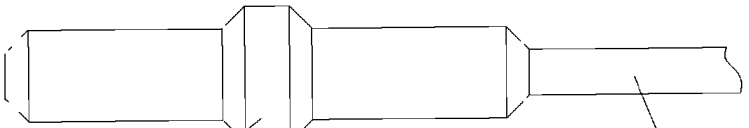
FIG. 6B depicts a shifting tool with the radially movable latch in the extended position on coil tubing.
Figure 6C:
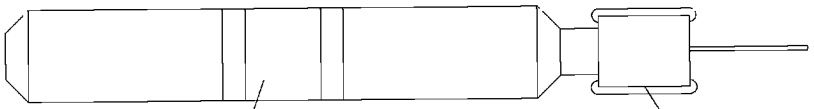
FIG. 6C depicts a shifting tool with the radially movable latch in the extended position on a wellbore tractor.

FIG. 6B depicts a shifting tool 100 with the radially movable latch 102B in its extended position. Once the shifting tool 100 is located in the profile 88 the movable latch is actuated from its radially retracted position 102A to its radially extended position 102B and engages profile 88 (FIG. 5) within the insert 82 (FIG. 5). Tension is then applied to move the shifting tool 100 and thereby insert 82 from its open position to its closed position to block fluid flow between the exterior of the housing 74 through the ports 90 and into the interior of the housing. Typically the tension is applied from the rig 40 (FIG. 1) on the surface however, as depicted in FIG. 6C any device such as an electrically (electric line 110) or hydraulically driven wellbore tractor 108 that can provide sufficient force to the shifting tool 100 to shift the insert 82 may be used.

Once the insert 82 is moved to its closed position tension from the surface is reduced. The movable latch on 102 on shifting tool 100 is moved from its extended position to its retracted position thereby disengaging profile 88. The shifting tool may then be moved to its next position to shift the insert on another tool or the shifting tool may be retrieved from the wellbore.

While the embodiments are described with reference to various implementations and exploitations, it will be understood that these embodiments are illustrative and that the scope of the inventive subject matter is not limited to them. Many variations, modifications, additions and improvements are possible. For example, the method of shifting the insert between an open position and a closed position as described herein is merely a single means of applying force to the sliding sleeve and any means of applying force to the sliding sleeve to move it between an open and a closed position may be utilized.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A downhole assembly comprising at least two sliding sleeves, each sliding sleeve further comprising:

a housing having an inner bore and having a port communicating the inner bore outside the housing;

an insert located within the inner bore of the housing and having a resettable seat and a shifting profile, the insert in a first position blocking fluid flow through the port, the insert in a second position allowing fluid flow through the port, the resettable seat having a set condition in the insert in the first position and having an unset condition in the insert in the second position;

wherein the resettable seat in the set condition is engagable in the insert to facilitate movement of the insert from the first position to the second position; and wherein the shifting profile is engagable in the insert to facilitate movement of the insert from the second position to the first position and to facilitate resetting of the resettable seat from the unset condition to the set condition;

wherein the resettable seat in each of the at least two sliding sleeves is sized to be actuated by a single ball.

2. The downhole assembly of claim 1, wherein the shifting profile is engaged by a shifting tool operated from the surface.

3. The downhole assembly of claim 2, wherein the shifting tool is moved by coiled tubing operated from the surface.

4. The downhole assembly of claim 2, wherein the shifting tool is moved by a wellbore tractor operated from the surface.

5. The downhole assembly of claim 2, wherein the shifting profile is engaged by a shifting tool operated from the wellbore.

6. The downhole assembly of claim 1, wherein the insert further comprises a retaining device retaining the insert in either the first position or the second position.

7. The downhole assembly of claim 1, wherein the retaining device is a snap ring.

8. A downhole well fluid system, comprising:

a plurality of sliding sleeves having a central throughbore and disposed on a tubing string deployable in a wellbore;

each of the sliding sleeves having an insert with a resettable seat being actuatable by a single ball deployable down the tubing string;

each of the inserts in the sliding sleeves actuated by the ball moving between a closed condition and an opened condition, the insert in the closed condition preventing fluid communication between the central throughbore and the wellbore and having the resettable seat in a set condition engagable by the ball, the insert in the opened condition permitting fluid communication between the central throughbore and the wellbore and having the resettable seat in an unset condition;

each of the inserts in the sliding sleeves in the opened condition allowing the single ball to pass through the resettable seat in the unset condition; and each of the inserts in the sliding sleeves being actuatable from the open position to the closed position and resetting the resettable seat to the set condition.

9. The downhole assembly of claim 8, wherein inserts in the sliding sleeves are actuable from the open position to the closed position by a shifting tool.

10. The downhole assembly of claim 9, wherein the shifting tool is operated from the surface.

11. The downhole assembly of claim 9, wherein the shifting tool is moved by coiled tubing operated from the surface.

12. The downhole assembly of claim 9, wherein the shifting tool is moved by a wellbore tractor operated from the surface.

13. The downhole assembly of claim 9, wherein the shifting tool is operated remotely.

14. The downhole assembly of claim 8, wherein the sliding sleeves further comprise a retaining device retaining the sliding sleeve in either a first position or a second position.

15. The downhole assembly of claim 8, wherein the retaining device is a snap ring.

16. A wellbore fluid treatment method, comprising:

deploying at least two sliding sleeves on a tubing string in a wellbore, each of the sliding sleeves having a central throughbore and a closed condition preventing radial fluid communication between the central throughbore and the wellbore;

dropping a ball down the tubing string;

moving the inserts in the sliding sleeves to an open condition allowing fluid communication between the central throughbore and the wellbore by engaging the ball on resettable seats disposed in set conditions in the inserts of the sliding sleeves;

passing the ball through each of the sliding sleeves by passing the ball through the resettable seat set to an unset condition with the insert in the open condition;

running a shifting tool down the tubing string; and moving the insert in at least one of the sliding sleeves to a closed condition reducing fluid communication between the central throughbore and the wellbore by engaging the shifting tool with a profile disposed in the insert of the at least one sliding sleeves and resetting the resettable seat to the set condition in the inserts.

17. The method of claim 16, further comprising actuating the sliding sleeves from the open position to the closed position by a shifting tool.

18. The method of claim 16, further comprising operating the shifting tool from the surface.

19. The method of claim 16, further comprising moving the shifting tool using coiled tubing operated from the surface.

20. The method of claim 16, further comprising moving the shifting tool using a wellbore tractor operated from the surface.

21. The method claim 16, further comprising operating the shifting tool remotely.

* * * * *